United States Patent [19]

Kogut

[11] Patent Number: 4,498,624

[45] Date of Patent: Feb. 12, 1985

[54] CONTROL UNIT WITH SEPARATE DAMPERS FOR MAKE-UP AND COMBUSTION AIR CIRCULATION

[76] Inventor: Jimmy A. Kogut, 14660 Cavell, Livonia, Mich. 48154

[21] Appl. No.: 607,439

[22] Filed: May 7, 1984

[51] Int. Cl.[3] ..... F24D 5/00

[52] U.S. Cl. ..... 237/53; 98/37; 98/119; 126/85 B; 126/112

[58] Field of Search ..... 98/33 A, 33 R, 37, 119; 237/46, 50, 53; 126/85 B, 112

[56] References Cited

U.S. PATENT DOCUMENTS

| | | | |
|---|---|---|---|
| 2,242,802 | 5/1941 | Stramaglia | 126/112 |
| 3,158,082 | 11/1964 | Dillingham et al. | 98/33 R |
| 4,175,538 | 11/1979 | McCarty | 126/112 |

*Primary Examiner*—Henry Bennett

*Attorney, Agent, or Firm*—Reising, Ethington, Barnard, Perry & Milton

[57] ABSTRACT

A control unit for make-up air and combustion air is disclosed for use with a furnace in an air circulating system for a building. A baffle having a combustion air inlet and a make-up air inlet is provided with a weather protective hood and adapted to be mounted on the outside wall of a building. The combustion air inlet is connected through a conduit to a location adjacent the floor of the building on which the furnace is mounted. The baffle includes a restrictor plate including a pair of openings aligned with the combustion air and make-up air inlets, respectively, and a screen extending across the openings. The baffle includes a damper in the make-up air inlet and a damper in the combustion air inlet. The dampers are mounted on a common shaft so that they move concurrently in response to a pressure differential between the inside and outside.

5 Claims, 6 Drawing Figures

CONTROL UNIT WITH SEPARATE DAMPERS FOR MAKE-UP AND COMBUSTION AIR CIRCULATION

FIELD OF THE INVENTION

This invention relates to air circulating systems for buildings; more particularly, it relates to an air circulating system for supplying make-up air and combustion air to a furnace.

BACKGROUND OF THE INVENTION

In buildings having a warm air heating system such as a forced air furnace with a gas or oil fired combustion chamber, there is a need for a controlled air supply to enter the interior of the building. In a house having such a heating system, it is considered desirable to reduce heat losses by sealing the openings, as by caulking around doors and windows and the like. If the house is sealed tightly, there is a chance inadequate combustion air will be supplied to the furnace resulting in the production of carbon monoxide, possibly at a dangerous level. Thus, there should be a provision for the supply of additional amounts of combustion air to enter without total dependence upon leakage through the walls, windows and doors of the house. Further, in the typical house there is an air loss by convection through fireplace chimneys, discharge by kitchen and bathroom fans, dryers and other such causes. This results in the depletion of interior air that contributes to a pressure differential being created between the inside and outside of the house. This differential in pressure tends to increase the influx of cold air through leakage in the walls with a concomitant energy loss. It is desirable to provide a supply of replacement or make-up air within a controlled environment to the interior of the house so as to equalize or tend to equalize the interior and exterior air pressure.

In the prior art, several systems and devices have been proposed for supplying make-up air to a building. Arrangements for supplying fresh air to the return air duct of a furnace through a pressure actuated damper is shown in the Dibert U.S. Pat. No. 3,204,870. Similar arrangements are shown in Elliott U.S. Pat. No. 2,721,033, Graden U.S. Pat. No. 4,138,062 and Powers U.S. Pat. No. 2,225,181.

The prior art also includes an arrangement for supplying outside air to the combustion chamber of a furnace. The Dyer U.S. Pat. No. 3,805,764 describes a fresh air supply duct which is connected directly to the furnace structure for supplying combustion air. Similar arrangements are disclosed in Schossow U.S. Pat. No. 4,171,089 and Grott U.S. Pat. No. 4,121,562.

It is also known in the prior art to supply combustion air to the combustion chamber and to supply draft air to the chimney. Such an arrangement is disclosed in the Dingwall U.S. Pat. No. 4,038,963 wherein a common air duct communicates with the exterior of the building and separate conduits extend from the duct to the chimney and to the combustion chamber. Similar arrangements are shown in Stramaglia U.S. Pat. No. 2,242,802 and the Bellaff U.S. Pat. No. 4,285,325.

In co-pending patent application Ser. No. 540,641 filed Oct. 11, 1983, by the inventor of this invention, a control unit for make-up air and combustion air is disclosed. The control unit has a baffle with a combustion air inlet and a make-up air inlet and is adapted to be mounted on the outside wall of the building. The baffle includes a restrictor plate with openings aligned with the combustion air and make-up air inlets. The baffle includes a damper in the make-up air inlet which opens in response to reduced pressure in the furnace return air duct so that the inside pressure tends to be equalized with the outside pressure. The combustion air inlet is unrestricted and is open at all times to admit outside air and thus when the furnace is running additional combustion air is supplied.

In general, it is an objective of this invention to provide an improved air circulating system for controlled supply of make-up and combustion air as required by forced air furnaces and air conditioner systems.

SUMMARY OF THE INVENTION

In accordance with this invention, an air circulating system is provided for use with the furnace system of a building to provide a controlled supply of make-up air and combustion air. This is accomplished by a control unit mounted in the wall of the building; the unit includes a baffle provided with a make-up air inlet connected to the return air duct of the furnace and with a combustion air inlet which communicates with the combustion chamber of the furnace. The baffle includes a damper in the make-up air inlet and a damper in the combustion air inlet with a coupling between the dampers so that they are actuated concurrently. A pressure differential between the outside air pressure and the air pressure in the return air duct, resulting from the furnace blower operation, causes the make-up air baffle to open and it acts through the coupling to open the combustion air baffle concurrently.

Further, in accordance with this invention, the control of make-up air and combustion air is provided by a single unit responsive to air pressure differential. This is accomplished by a control unit mounted in the wall of the building and including a baffle provided with a make-up air inlet and damper and with a combustion air inlet and damper. The dampers are mounted on a common shaft so that they are actuated concurrently by pressure differential on one or both dampers.

A more complete understanding of this invention will be obtained from the detailed description that follows taken with the accompanying drawings.

BEST MODE FOR CARRYING OUT THE INVENTION

Figure 1:
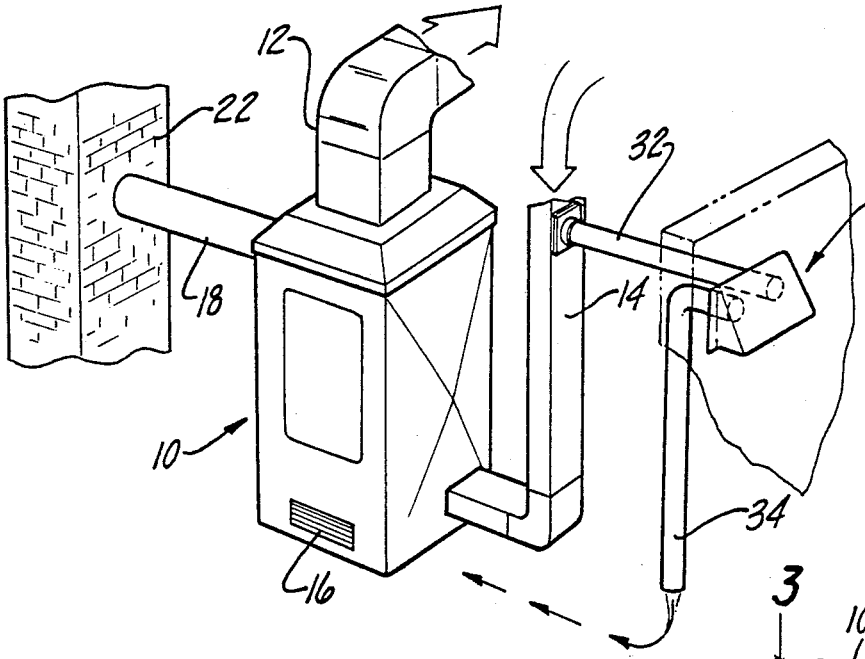
FIG. 1 shows the control unit of this invention installed in the air circulating system of a furnace.

Referring now to the drawings, there is shown an illustrative embodiment of the invention in a control unit for make-up and combustion air for use in the air circulating system of a house. The air circulating system of the illustrative embodiment includes a forced air furnace installed in a basement of a house, as is typical in residential heating. The control unit is mounted in the wall above grade and provided with side-by-side fresh air inlets. It will be appreciated, as the description proceeds, that the control unit is useful in other installations and in other embodiments.

FIG. 1 illustrates a typical furnace installation in the basement of a house with the control unit of this invention connected in the air circulating system. A furnace 10, installed on the floor of the basement, is a conventional forced air unit with a hot air duct 12 which delivers heated air to various parts of the house. The furnace is provided with a cold air return duct 14 which returns air from the different rooms of the house to the furnace for heating thereby. The furnace includes a blower (not shown) between the return duct 14 and the hot air duct 12 for forcing circulation through the house. The furnace has a combustion chamber (not shown) which is fuel-fired by gas or oil and which is supplied with combustion air through a vent 16 in the housing of the furnace. The furnace is connected through a flue 18 to a chimney 22 for conveying the products of combustion to the exterior of the house.

A control unit 30 is installed in the wall of the house, preferably a small distance above grade so that it is below the level of the basement ceiling. As shown in FIG. 1, the control unit 30 is connected through a make-up air conduit 32 to the return air duct 14. It is also connected with a combustion air conduit 34 which terminates at a location adjacent the basement floor.

Figure 3:
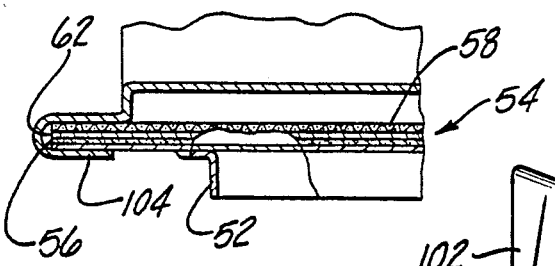
FIG. 3 is a sectional view taken on lines 3—3 of FIG. 2.
Figure 2:
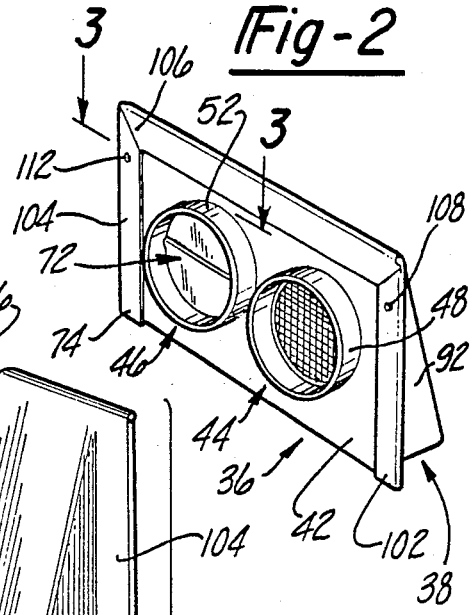
FIG. 2 is a perspective view of one embodiment of the control unit.
Figure 4:
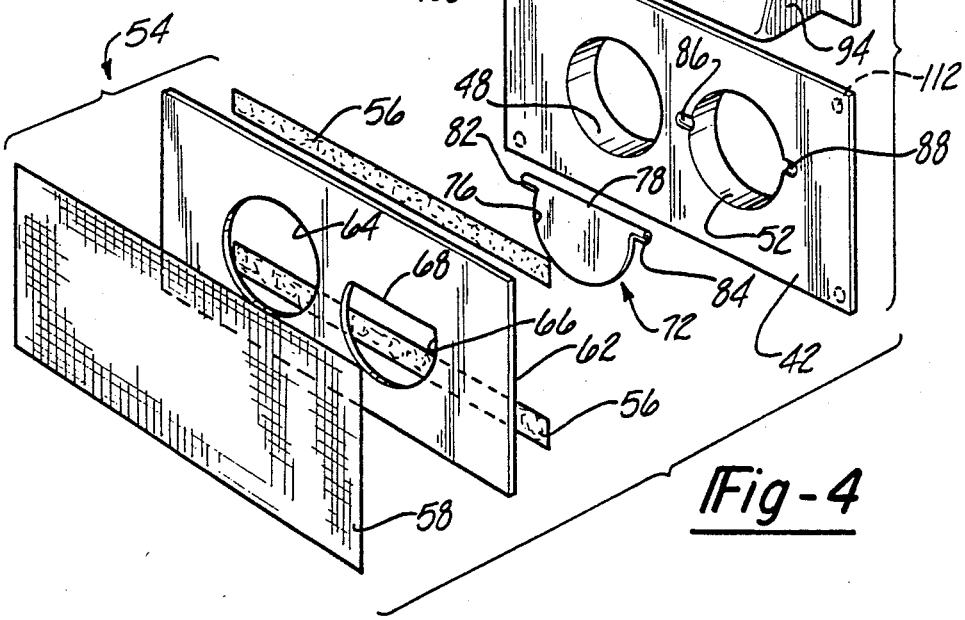
FIG. 4 is an exploded view of the control unit of FIG. 2.

The make-up air and combustion air control unit 30 will be described with reference to FIGS. 2, 3 and 4. The control unit 30 comprises, in general, a baffle 36 and a weather protective hood 38. The baffle 36 comprises a baffle plate 42 provided with a combustion air inlet 44 and a make-up air inlet 46. The combustion air inlet 44 is defined by an annular flange 48 of circular cross-section. Similarly, the make-up air inlet 46 is defined by an annular flange 52 of circular cross-section. Preferably, the baffle plate 42 and the flanges 48 and 52 are of unitary construction and formed of sheet metal. The baffle 36 also comprises a restrictor plate 54 which is disposed in face-to-face engagement with the outisde of the baffle plate 42. The restrictor plate 54 is a laminated structure including an adhesive sheet, a screen, and a cardboard sheet.

The adhesive sheet comprises one or more flexible tapes 56 of plastic material having a pressure sensitive adhesive material on both surfaces. The adhesive tapes 56 are supplied with a protective carrier sheet over both surfaces and the carrier sheets are peeled off prior to use. The screen 58 is a conventional industrial wire screen of the type having wire barbs at each of the wire intersections and having a mesh similar to that of conventional window screen. The cardboard sheet 62 is a moisture resistant material and is stiff enough to be self-sustaining. The restrictor plate 54 is suitably laminated and die-cut in a single operation, as will be described.

The restrictor plate 54 is provided with a circular opening in the cardboard sheet 62 defined by a circular edge 64 having a radius substantially equal to that of the annular flange 48 and disposed in axial alignment therewith. The restrictor plate 54 also includes an opening in the cardboard sheet 62 defined by an edge having a circular portion 66 and a straight portion 68. The circular portion 66 has a radius which is slightly smaller than the radius of the annular flange 52 and it is axially aligned therewith. The straight portion 68 extends along a chord line of the circular portion 66.

In forming the restrictor plate 54, the screen 58 and the cardboard sheet 62 are precut in rectangular shape of the same size, slightly less than the dimensions of the baffle plate 44. The cardboard sheet 62 is laid against the screen 58 and they are placed in a press which simultaneously presses the laminations together and die-cuts the required openings in the cardboard sheet 62 by a so-called kiss-cutting operation. The carrier sheet is removed from one surface of the adhesive tapes 56 and they are applied to the inside surface of the cardboard sheet 62. In the resulting laminated restrictor plate 54, the cardboard sheet 62 and the tapes 56 are adhesively bonded together and the cardboard sheet 62 is securely held to the screen 58 by the penetration of the wire barbs into the cardboard sheet. The restrictor plate 54 is a rigid structure and is mounted onto the outside surface of the baffle plate 44 by pressing the exposed adhesive surface against the tapes 56 against the baffle plate, the openings being properly aligned with the inlets 44 and 46.

The baffle 36 also comprises a damper 72 which is mounted on the baffle plate 42. The damper 72 comprises a plate bounded by an edge having a circular portion 76 and a straight portion 78. The circular portion has a radius slightly smaller than the inside radius of the annular flange 52 so as to provide a small clearance therebetween. The straight portion 78 of the edge extends along a chord line of the circular portion 76 such that the damper constitutes more than a semi circle. The damper is provided with a pair of tabs 82 and 84 which are disposed at opposite ends of the straight portion 78 of the edge of the plate 74. Preferably, the damper is made of sheet metal and the tabs 82 and 84 are unitary therewith, the tabs being formed into a roll so as to constitute hinge or pivot pins.

The baffle plate 42 is provided on its outer surface with a pair of recesses 86 and 88 which are located in substantial alignment with the straight portion 68 of the opening in the cardboard sheet 62 and disposed at opposite ends thereof. The recesses 86 and 88 are of sufficient size to receive the tabs 82 and 84, respectively, and permit free rotation of the tabs therein about the straight portion 78 as a hinge axis. The tabs 82 and 84 are retained in the recesses 86 and 88, respectively, by the restrictor plate 54.

The weather protective hood 38 comprises a pair of triangular end walls 92 and 94 and a sloping roof 96. The end walls are provided with mounting flanges 102 and 104, respectively, and similarly, the roof is provided with a mounting flange 106. The flanges define a channel which receives the top and side edges of the baffle plate 42 and the restrictor plate 54 such that the baffle 36 and the hood 38 may be assembled by sliding engagement. The hood 38 is secured to the baffle 36 by a pair of protruberances 108 and 112 on the baffle plate 42 which snap into corresponding holes in the edge flanges 102 and 104.

The control unit 30 is installed on the exterior of the house wall as illustrated in FIG. 1. The make-up air inlet 46 is connected through the conduit 32 with the return air duct 14. The conduit 32 has one end connected by a telescope joint with the annular flange 52 on the control unit 30. The other end of the conduit 32 is connected with the return air duct by a suitable fitting as shown. The combustion air inlet 44 is in fluid communication with the combustion chamber of the furnace 10 through the conduit 34. This conduit has one end connected by a telescope joint with the annular flange 48 on the control unit 30. The other end of the conduit 34 terminates at a location a few inches above the floor on which the furnace 10 is mounted.

With the furnace in operation, the control unit 30 functions to insure that there is an additional supply of combustion air; further, it functions to decrease the imbalance between the air pressure inside and outside the house. Combustion air is supplied through the inlet 44 and the conduit 34 to the floor of the basement where it is used for combustion as needed. With the blower of the furnace in operation, the air pressure in the return air duct 14 is reduced and thus a pressure differential is established such that the pressure in the condiut 32 on the inside of the damper 72 is lower than that on the outside of the damper. The damper 72 is biased by gravity to the vertical position in which the damper closes the make-up air inlet 46. However, when the pressure differential between the internal and external pressures increases to a predetermined value, the damper pivots inwardly about the axis of the tabs 82 and 84 and make-up air inlet 46 is opened. This admits external air to the house through the return air duct 14 tending to equalize the pressure inside the house with that outside the house. The damper 72 may open in response to pressure differential which may be created by exhaust fans or the like, even when the furnace blower is shut off. The value of the pressure differential required to open the damper 72 is, of course, determined by the bias force due to gravity acting on the damper 74. In a furnace installation which includes an air conditioning heat exchanger, the control unit 30 functions to supply make-up air in the same manner as described above. Thus, in either the heating mode or cooling mode, the control unit tends to equalize the indoor pressure with the outdoor pressure and thereby reduces energy loss which would otherwise result from the inflow of outside air into the house not under a controlled environment.

Figure 5:
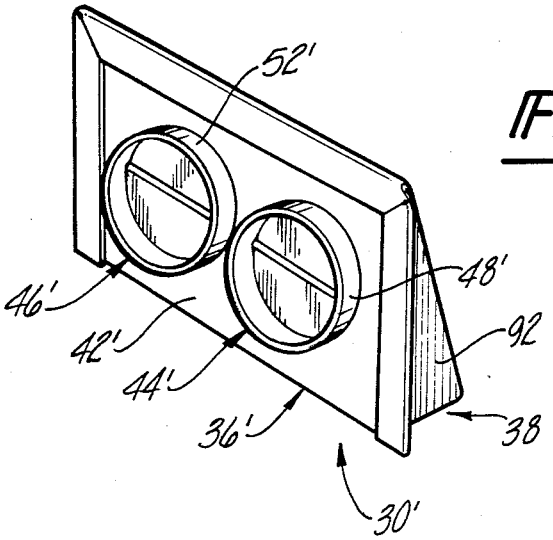
FIG. 5 is a perspective view of another embodiment of the control unit.
Figure 6:
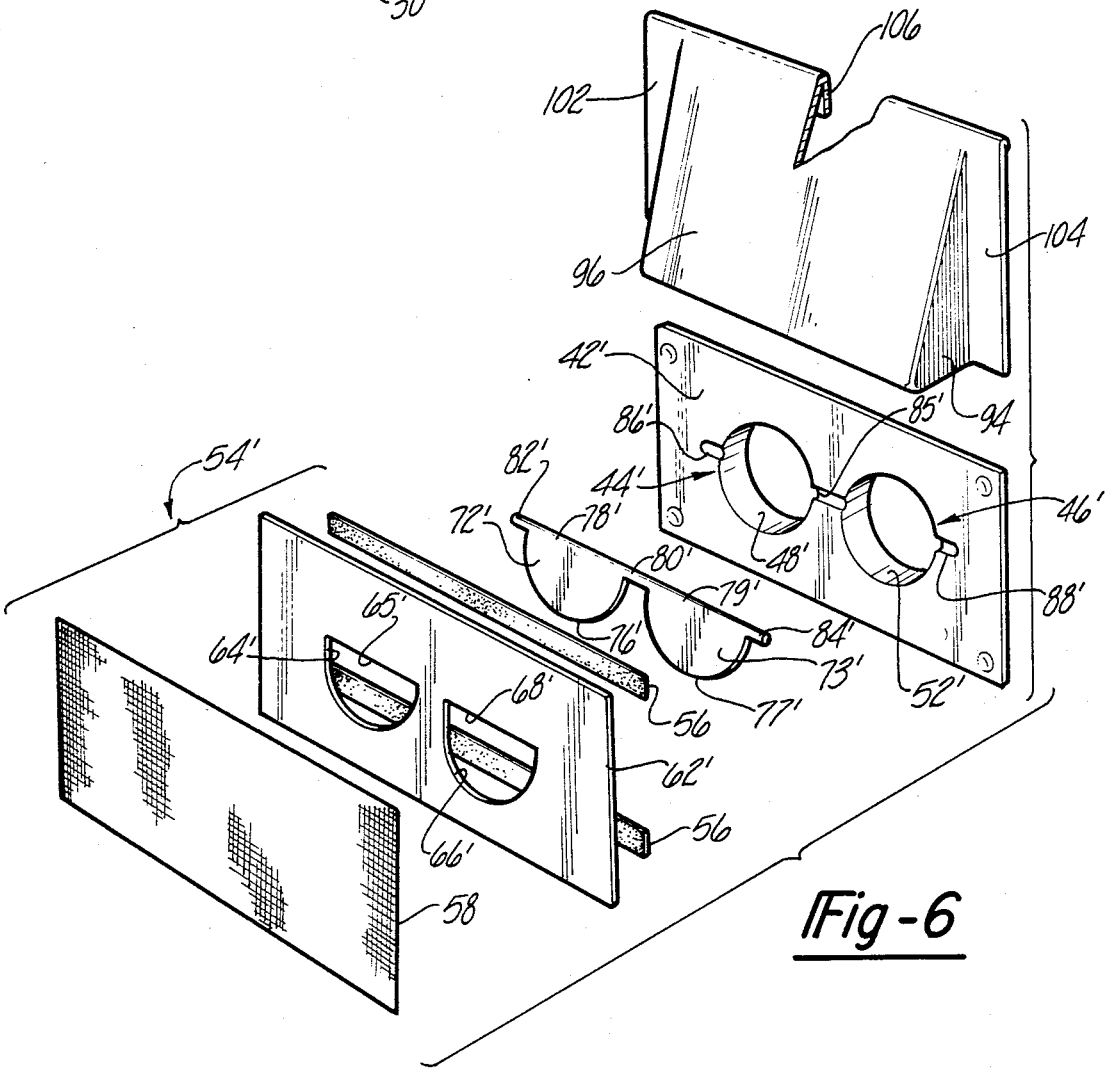
FIG. 6 is an exploded view of the control unit of FIG. 5.

Referring not to FIGS. 5 and 6, there is shown another embodiment of the invention. In this embodiment, the make-up air and combustion air control unit 30 comprises, in general, the baffle 36' and a weather protective hood 38. In this embodiment, those parts which are the same as in the embodiment of FIGS. 2, 3 and 4 are designated by the same reference characters. Those parts which correspond to but are different from those in the embodiment of FIGS. 2, 3 and 4 are designated by the same reference number but with a prime symbol. The baffle 36' comprises a baffle plate 42' provided with a combustion air inlet 44' and a make-up air inlet 46'. The combustion air inlet is defined by an annular flange 48' of circular cross-section and the make-up air inlet 46 is defined by an annular flange 52' of circular cross-section. The restrictor plate 54' is disposed in face-to-face engagement with the outside of the baffle plate 42' and is of the same laminated structure as described with reference to restrictor plate 54.

The restrictor plate 54' is provided with an opening in the cardboard sheet 62' defined by an edge having a circular portion 64' and a straight portion 65'. The straight portion 65' extends along a chord line of the circular portion 64'. The cardboard sheet 62 also includes an opening defined by a flange having a circular portion 66' and a straight portion 68'. The straight portion 68' extends along the chord line of the circular portion 66'. The circular portions 64' and 66' have a radius which is slightly smaller than the radius of the annular flanges 48' and 52' and are aligned therewith, respectively.

The baffle 36' comprises a damper 72' for the combustion air inlet 44' and a damper 73' for the make-up air inlet 46'. The damper 72' comprises a plate bounded by an edge having a circular portion 76' and a straight portion 78'. Similarly, the baffle 73' has a circular portion 77' and a straight portion 79'. The dampers 76' and 77' have a common shaft 80' which couple the dampers together for concurrent pivotal motion thereof. The damper 72' is provided with a shaft portion or tab 82' and the damper 73' is provided with a shaft portion or tab 84'. The tabs 82' and 84' are coaxial with the common shaft 80'. Preferably, the dampers 72' and 73' are made of sheet metal and the common shaft 80' and tabs 82' and 84' are unitary therewith and formed so as to provide a shaft of circular cross-section.

The baffle plate 42' is provided on its outer surface with a groove or recess 85 between the combustion air inlet 44' and the make-up air inlet 46'. It is also provided with a pair of recesses 86' and 88' adjacent the inlets 44' and 46', respectively. The recesses 85', 86' and 88' are located in substantial alignment with the straight portions 65' and 68' of the opening in the cardboard sheet 62'. The recesses are substantially semicircular in cross-section and are of sufficient size to receive the shaft 80' and the tabs 82' and 84' to permit free rotation thereof in the recesses. The dampers 72' and 73' are biased by gravity to the vertical position in which the dampers close the make-up air inlet 46 and the combustion air inlet 44', respectively.

In operation, the control unit 30' functions to insure that there is an additional supply of combustion air when the furnace is in operation and yet it keeps the combustion air inlet 44' closed unless there is a predetermined pressure differential between the inside and outside of the house. Further, it functions to decrease the differential between the air pressure inside and outside the house. First, the operation will be described where, for explanatory purposes, it will be assumed that the pressure inside the house (in the vicinity of the control unit 30') is substantially the same as the pressure outside the house. Under the assumed condition, and with the furnace blower not running, the air pressure in the return air duct 14 will be substantially the same as the other pressure inside the house. However, with the blower running, the air pressure in the return air duct 14 is reduced and a pressure differential is established such that the pressure in the conduit 32 on the inside of the damper 72' is lower than that on the outside of the damper. At a predetermined value of differential pressure, the force on damper 72' will overcome the bias force due to gravity. As a result, the damper 72', and also the damper 73', pivot inwardly and both the combustion air inlet 44' and the make-up air inlet 46' are opened. This admits external air to the house through the inlets 44' and 46' tending to maintain the pressure inside the house equal to that outside the house and it also supplies additional combustion air. Operation of the control unit 30' will now be described, for explanatory purposes, with the assumption that there is a pressure differential between the inside and outside of the house when the furnace blower is not running. This condition may be created by exhaust fans or the like which tend to reduce the pressure inside the house. Under this assumed operating condition, the pressure differential between the inside and outside of the house results in an opening force acting on the damper 72' and the damper 73'. At a predetermined value of pressure differential, the combined forces on the dampers will overcome the bias force due to gravity and the dampers will open concurrently. In a furnace installation which includes an air conditioning heat exchanger, the control unit 30' functions to supply make-up air and to equalize the pressure inside the house with that outside the house. Thus, in either the heating mode or the cooling mode, the control unit 30' tends to equalize the pressures and thereby reduces energy loss which would otherwise result from the inflow of outside air into the house without control of the environment by the control unit.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. In an air circulating system for a building, said system being of the type including a furnace having a combustion chamber and a heat exchanger, a first duct for conducting air to said heat exchanger, a second duct for conducting air from said heat exchanger, an intermittently operable blower for forcing air flow through said heat exchanger, the passage of air through said first duct causing a reduced pressure in said first duct, and make-up air supply means communicating between the outside of said building and said first duct, the improvement comprising:

a control unit adapted to be mounted in an outside wall of said building and including a baffle defining separate make-up and combustion air inlets and including a weather protective hood, said baffle also including a first damper disposed within said make-up air inlet and a second damper disposed within said combustion air inlet, said dampers being mounted for pivotal motion inwardly of said baffle, coupling means between said dampers for causing concurrent pivotal motion thereof, said make-up air supply means comprising a conduit extending from said make-up air inlet to said first duct whereby reduced pressure in said first duct causes said damper to open inwardly and admit outside air to said first duct, and combustion air supply means comprising a conduit extending from said combustion air inlet to a location in communication with said combustion chamber.

2. The invention as defined in claim 1 wherein, said baffle includes a screen extending across each of said inlets, said baffle includes a member defining a first opening having a straight edge extending horizontally across said make-up air inlet adjacent the upper portion thereof and defining a second opening having a straight edge extending horizontally across said combustion air inlet adjacent the upper portion thereof, said first and second dampers are disposed within said make-up air inlet and combustion air inlet, respectively, in face-to-face relation with said screen and having straight upper edges parallel to and adjacent the straight edges of said openings, said dampers being mounted on a common shaft for pivotal motion about a horizontal axis adjacent said straight upper edges.

3. The invention as defined in claim 1 wherein said baffle comprises:

a baffle plate having first and second circular openings for said make-up air and combustion air inlets, respectively, said openings being bounded by first and second axially extending annular flanges, a restrictor plate including said screen and a sheet number having third and fourth openings aligned with said first and second openings, respectively, each of said third and fourth openings being bounded by a circular edge portion and a straight edge portion extending horizontally across the top thereof, said dampers being disposed within said make-up air inlet and combustion air inlet, respectively, in face-to-face relation with said screen and having straight upper edges parallel to and adjacent the straight edges of said openings, said dampers being mounted on a common shaft for pivotal motion about a horizontal axis adjacent said straight upper edges.

4. The invention as defined in claim 3 wherein, said dampers include a pair of unitary pivot pins extending from opposite ends of said straight upper edges and a shaft connected between said straight upper edges, said baffle plate including recesses therein for receiving said pins and said shaft, said pivot pins and shaft being held captive in said recesses by said restrictor plate.

5. The invention as defined in claim 3 wherein said restrictor plate includes a sheet of material having an adhesive on both sides, one side of said sheet of material being adhered to said screen and the other side being adhered to said baffle plate.

* * * * *